US009416593B2

(12) United States Patent
Gan et al.

(10) Patent No.: US 9,416,593 B2
(45) Date of Patent: Aug. 16, 2016

(54) PISTON STRIKE FACE AND BIT INTERFACE FOR PERCUSSION HAMMER DRILL

(71) Applicant: Smith International, Inc., Houston, TX (US)

(72) Inventors: Xiaoge Gan, Houston, TX (US); Lokesh Bhatia, Houston, TX (US); Kevin E. Harrington, Houston, TX (US); Robert H. Slaughter, Jr., Spring, TX (US)

(73) Assignee: Smith International, Inc., Houston, TX (US)

( * ) Notice: Subject to any disclaimer, the term of this patent is extended or adjusted under 35 U.S.C. 154(b) by 290 days.

(21) Appl. No.: 14/105,867

(22) Filed: Dec. 13, 2013

(65) Prior Publication Data

US 2014/0182938 A1 Jul. 3, 2014

Related U.S. Application Data

(60) Provisional application No. 61/746,777, filed on Dec. 28, 2012.

(51) Int. Cl.
*E21B 4/14* (2006.01)

(52) U.S. Cl.
CPC ..... *E21B 4/14* (2013.01); *Y10T 29/49826* (2015.01)

(58) Field of Classification Search
CPC ..... E21B 4/06; E21B 4/08; E21B 4/12; E21B 4/14; E21B 4/145
See application file for complete search history.

(56) References Cited

U.S. PATENT DOCUMENTS

| | | | | |
|---|---|---|---|---|
| 1,744,141 | A | 1/1930 | Pryce | |
| 1,776,057 | A | 9/1930 | Weibull | |
| 2,407,604 | A | 9/1946 | Goldschmidt | |
| 3,303,892 | A * | 2/1967 | Nishimura | B21J 7/26 173/133 |
| 3,833,072 | A | 9/1974 | Back | |
| 3,978,931 | A | 9/1976 | Sudnishnikov | |
| 4,067,402 | A | 1/1978 | Schnell | |
| 4,821,813 | A | 4/1989 | Jenne et al. | |
| 4,867,366 | A | 9/1989 | Kleinholz | |
| 5,050,687 | A | 9/1991 | Prokhorov et al. | |
| 5,066,070 | A | 11/1991 | Clarke | |
| 5,111,801 | A | 5/1992 | Katoh | |

(Continued)

FOREIGN PATENT DOCUMENTS

GB 301230 A 11/1928

OTHER PUBLICATIONS

Jones, Norman; "Dynamic Energy Absorption and Perforation of Ductile Structures," International Journal of Pressure Vessels and Piping; Sep. 2010; pp. 482-492; vol. 87; Iss. 9.

(Continued)

*Primary Examiner* — David Andrews

(57) ABSTRACT

A percussion drilling assembly includes a housing with a hammer bit disposed in the lower end portion thereof and configured to move longitudinally within the housing. The hammer bit includes an annular bit shank having a bit strike face and a cutting structure at a lower end portion thereof. An annular piston having a piston strike face arranged and designed to strike the bit strike face is also disposed in the housing. At least one of the bit strike face and the piston strike face has a toroidal curvature profile. A method includes one or more of lowering the percussion drilling assembly into a borehole, engaging the cutting structure with a formation, and impacting the bit strike face of the annular bit shank with the piston strike face of the annular piston.

18 Claims, 6 Drawing Sheets

(56) References Cited

U.S. PATENT DOCUMENTS

| | | | |
|---|---|---|---|
| 5,662,180 | A | 9/1997 | Coffman et al. |
| 5,887,665 | A | 3/1999 | Seifert et al. |
| 5,954,145 | A | 9/1999 | Hesse et al. |
| 6,155,353 | A | 12/2000 | Ottestad |
| 6,557,653 | B2 | 5/2003 | Hauptmann et al. |
| 6,568,484 | B1 | 5/2003 | Schmid et al. |
| 6,675,908 | B1 | 1/2004 | Frauhammer et al. |
| 6,799,644 | B2 | 10/2004 | Hoop et al. |
| 6,808,026 | B2 | 10/2004 | Berger et al. |
| 7,140,450 | B2 | 11/2006 | Reed |
| 7,252,155 | B2 | 8/2007 | Goetzfried et al. |
| 7,503,628 | B2 | 3/2009 | Hall et al. |
| 7,614,460 | B2 | 11/2009 | Henriksson et al. |
| 7,677,327 | B2 | 3/2010 | Meixner et al. |
| 2006/0180352 | A1* | 8/2006 | Mocivnik ..... E21B 7/20 175/57 |
| 2012/0023833 | A1 | 2/2012 | Hall et al. |

OTHER PUBLICATIONS

Zeinoddini, M.; Parke, G.A.R.; Harding, J.E.; "Interface Forces in Laterally Impacted Steel Tubes," Experimental Mechanics; Feb. 27, 2008; pp. 265-280; vol. 48; Society for Experimental Mechanics.

* cited by examiner

PISTON STRIKE FACE AND BIT INTERFACE FOR PERCUSSION HAMMER DRILL

CROSS-REFERENCE TO RELATED APPLICATIONS

This application claims the benefit of, and priority to, U.S. Patent Application Ser. No. 61/746,777, filed on Dec. 28, 2012 and entitled "PISTON STRIKE FACE AND BIT INTERFACE FOR PERCUSSION HAMMERS," which application is hereby incorporated herein by this reference in its entirety.

BACKGROUND

In percussion or hammer drilling operations, a drill bit mounted to the lower end portion of a drill string rotates and impacts the earth in a cyclic fashion to crush, break, and loosen formation material. In such operations, the mechanism for penetrating the earthen formation is of an impacting nature, rather than shearing. The impacting and rotating hammer bit engages the earthen formation and proceeds to form a borehole along a predetermined path toward a target zone. The borehole created will have a diameter about equal to the diameter or "gage" of the drill bit.

A typical percussion drilling assembly is coupled to the lower end portion of a rotatable drill string and includes a downhole piston-cylinder assembly coupled to the hammer bit. The impact force is generated by the downhole piston-cylinder assembly and transferred to the hammer bit. During drilling operations, a pressurized or compressed fluid flows down the drill string to the percussion drilling assembly. A choke is provided to regulate the flow of the compressed fluid to the piston-cylinder assembly and the hammer bit. A fraction of the compressed fluid flows through a series of ports and passages to the piston-cylinder assembly, thereby actuating the reciprocal motion of the piston, and then is exhausted through a series of passages in the hammer bit body to the bit face. The remaining portion of the compressed fluid flows through the choke and into the series of passages in the hammer bit body to the bit face. The compressed fluid exiting the bit face serves to flush cuttings away from the bit face to the surface through the annulus between the drill string and the borehole sidewall.

In oil and gas drilling, the cost of drilling a borehole is very high, and is generally proportional to the length of time it takes to drill to the desired depth and location. The time to drill the well, in turn, is greatly affected by the number of times the drill bit or other component of the percussion drilling assembly is replaced before reaching the targeted formation. Each time a drilling assembly component is changed, the entire string of drill pipe—which may be miles long—is retrieved and removed section by section from the borehole or borehole. Once the drill string has been retrieved and the new component installed, the drilling assembly is lowered to the bottom of the borehole on the drill string, which again is constructed section by section. This process, known as a "trip" of the drill string, takes considerable time, effort and expense.

During drilling, the piston of the downhole hammer repeatedly impacts a drill bit strike face on the shank of a hammer bit. Given the magnitude of the repeated impact forces, large impact stresses occur in each member at the strike interface. In some cases, sustained impact forces may cause plastic deformation and even mechanical failure at either or both of the piston or drill bit strike faces. Additionally, fluid may become trapped between the strike faces, causing an uneven distribution of stress. So-called wash off may likewise cause mechanical failure. Replacing a damaged part due to such a failure may be costly to the operator, because the drill string may need to be tripped in order to replace the damaged part.

SUMMARY

In one or more embodiments disclosed herein, a percussion drilling assembly includes a hammer bit and an annular piston. The hammer bit and annular piston may each be at least partially located within a housing capable of being coupled to a drill string. An annular bit shank of the hammer bit may include a bit strike face and cutting structure at respective upper end and lower end portions. The hammer bit may be arranged and designed to move longitudinally within the housing. The annular piston may include a piston strike face positioned at a lower end portion thereof, which piston strike face may be arranged and designed to strike the bit strike face. At least one of the bit strike face or the piston strike face may have a toroidal curvature profile.

In one or more embodiments disclosed herein, a method of manufacturing a percussion drilling assembly includes forming a housing having upper and lower end portions. The upper end portion may be configured to couple to a drill string. A hammer bit may be formed with an annular bit shank with a bit strike face at an upper end portion, and a cutting structure at a lower end portion. A longitudinally movable annular piston may be formed with a piston strike face at the lower end portion. A toroidal curvature profile may be formed on the hammer bit strike face and/or the piston strike face, and the longitudinally movable annular piston may be positioned in the housing. The hammer bit may be positioned at a position that is axially lower relative to the longitudinally movable annular piston, such that the hammer bit strike face is opposite the piston strike face.

In one or more embodiments disclosed herein, a method of drilling with a percussion drilling assembly includes lowering a percussion drilling assembly into a borehole. The percussion drilling assembly includes a housing, a hammer bit, and an annular piston. The housing includes upper and lower end portions, and the upper end portion is capable of being coupled to a drill string. The hammer bit may be located in the lower end portion of the housing and configured to move longitudinally within the housing, and may further include an annular bit shank with a bit strike face and cutting structure at respective upper and lower end portions. The annular piston may be located within the housing and can have a piston strike face at a lower end portion thereof. The piston strike face may be arranged and designed to strike or impact the bit strike face, and the bit strike face and/or the piston strike face may have a toroidal curvature profile. The method may further include engaging the cutting structure of the percussion drilling assembly with a formation and causing the bit strike face to impact the piston strike face.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

One or more embodiments of a piston strike face and bit interface for percussion hammers are described with reference to the following figures. The figures are drawn to scale for certain embodiments; however, a person of ordinary skill in the art should appreciate in view of the disclosure herein that the illustrated embodiments are not to scale for each embodiment contemplated herein or within the scope of the appended claims. The drawings may therefore also represent schematic or exaggerated illustrations of other embodiments.

DETAILED DESCRIPTION

Figure 1:
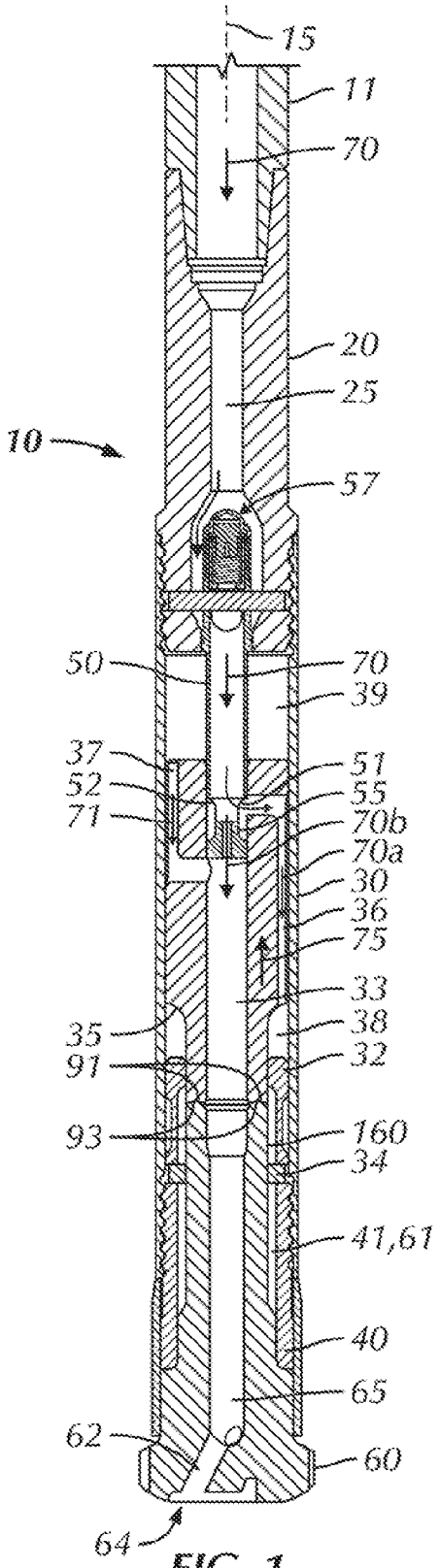
FIG. 1 is a cross-sectional view of a percussion drilling assembly coupled to a lower end portion of a drill string, the percussion drilling assembly having an annular piston in a lowermost position in accordance with one or more embodiments disclosed herein.

The following discussion is directed to various illustrative embodiments. One skilled in the art will understand in view of the disclosure herein that the following description has broad application, and the discussion of any embodiment is meant only to be illustrative of that embodiment, and not intended to suggest that the scope of the disclosure, including the claims, is limited to that embodiment. The embodiments disclosed should not be interpreted, or otherwise used, as limiting the scope of the disclosure, including the claims.

Certain terms are used throughout the following description, and claims, to refer to particular features or components. As one skilled in the art will appreciate in view of the disclosure herein, different persons may refer to the same feature or component by different names. This document does not intend to distinguish between components or features that differ in name but not function. The drawing figures are to scale for some embodiments, but are not to scale for each embodiment contemplated herein or within the scope of the claims. Indeed, certain features and/or components may be shown exaggerated in scale or in somewhat schematic form relative to other embodiments. Some details of conventional elements may not be shown in interest of clarity and conciseness.

In the following discussion and in the claims, the terms "including" and "comprising" are used in an open-ended fashion, and thus should be interpreted to mean "including but not limited to . . . . " Also, the term "couple" or "couples" is intended to mean either an indirect or direct connection. Thus, if a first device couples to a second device, that connection may be through a direct or even integral connection, or through an indirect connection via other devices and connections. Further, the terms "axial" and "axially" mean generally along or parallel to a central or longitudinal axis, while the terms "radial" and "radially" mean generally perpendicular to a central longitudinal axis.

In one aspect, one or more embodiments disclosed herein relate to an interface between strike faces of an annular shank of a hammer bit and an annular piston. One or more of the strike faces may incorporate a toroidal curvature profile, and the curvature profile may increase wear resistance of the annular shank and the annular piston by removing stress concentrations and thereby resisting, if not preventing, plastic deformation.

Figure 2:
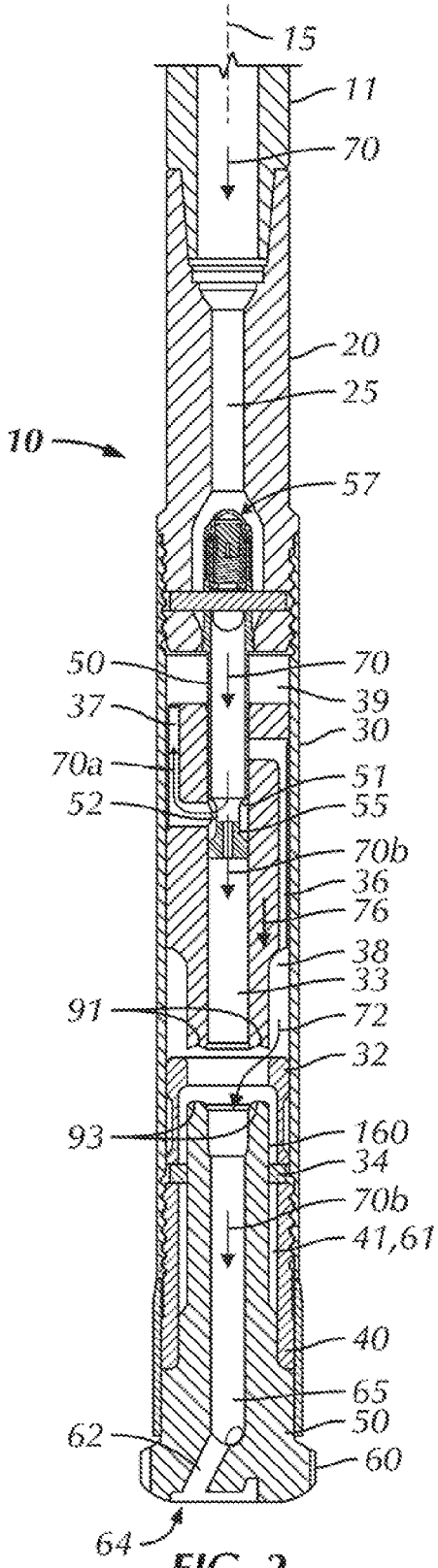
FIG. 2 is a cross-sectional view of the percussion drilling assembly of FIG. 1 with the annular piston in an uppermost position in accordance with one or more embodiments disclosed herein.
Figure 3:
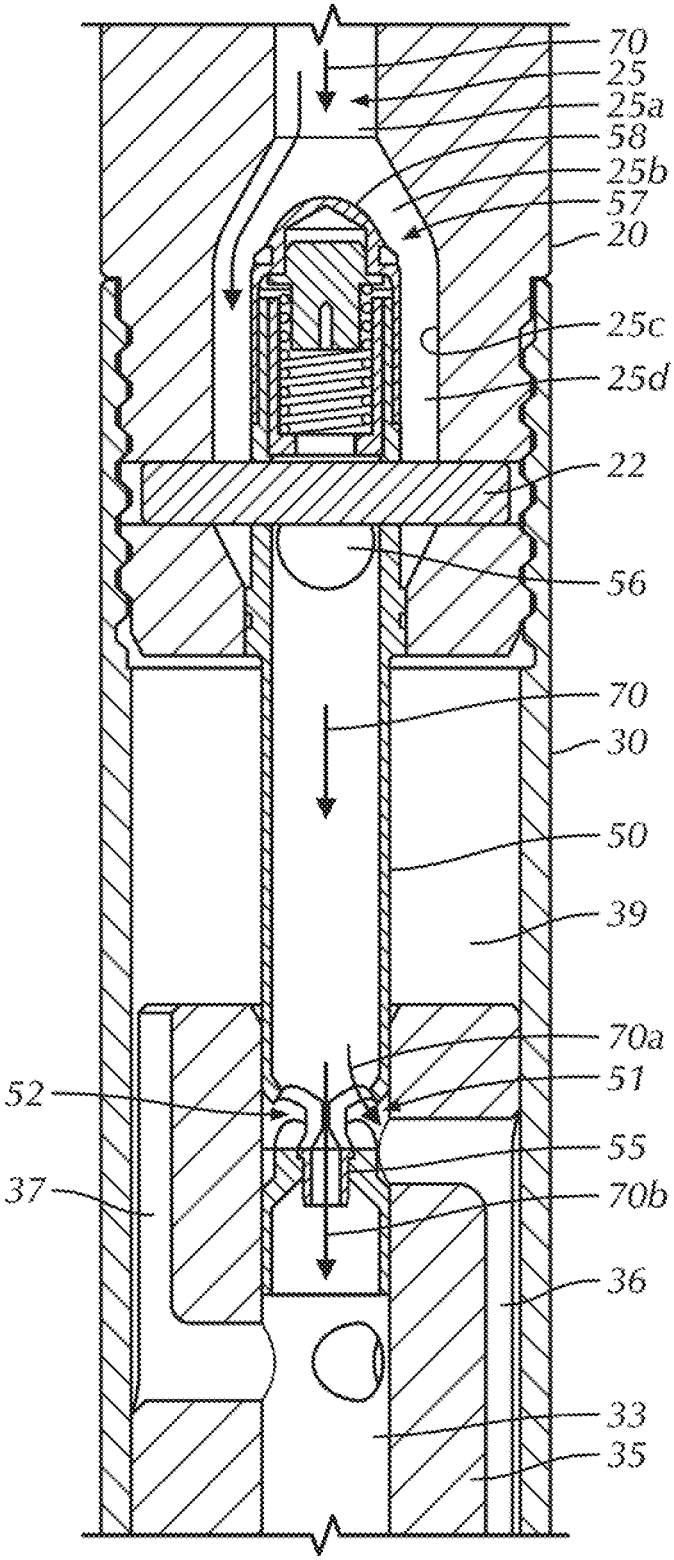
FIG. 3 is an enlarged partial cross-sectional view of the percussion drilling assembly of FIG. 1.

Referring now to FIGS. 1-3, an example percussion drilling assembly 10 is shown in accordance with one or more embodiments disclosed herein. One having ordinary skill in the art will understand in view of the disclosure herein that any percussion drilling assembly may be substituted for the one here described and may fall within the scope of this disclosure. In some embodiments, percussion drilling assembly 10 may be coupled to the lower end portion of a drill string 11 and may include a top sub 20 and a driver sub 40. A substantially cylindrical housing 30 may be axially disposed or positioned between top sub 20 and driver sub 40. An annular piston 35 may be slidingly disposed in the cylindrical housing 30. The annular piston 35 may include a piston strike face 91 at a lower end portion.

A hammer bit 60 may be slidingly received by driver sub 40. The lower end portion of hammer bit 60 may include a cutting structure. The upper portion of hammer bit 60 may form an annular bit shank 160 which can include a bit strike face 93 at its upper end portion. A fluid conduit 50 may extend between top sub 20 and annular piston 35. Top sub 20, cylindrical housing 30, annular piston 35, driver sub 40, fluid conduit 50 and hammer bit 60 may be generally coaxially aligned, each sharing a common central or longitudinal axis 15. Fluid (e.g., compressed fluid) may flow through the inside of fluid conduit 50 and exit radially outward into ports in annular piston 35 to provide air to upper and lower piston-cylinder chambers that actuate annular piston 35. Consequently, fluid conduit 50 may also be referred to as a "feed tube." As is known to persons having ordinary skill in the art, percussion drilling assemblies may alternatively utilize an air distributor assembly, in which air is directed radially inward from an outer radial location into upper and lower piston-cylinder chambers.

Top sub 20 may be threadingly coupled between the lower end portion of drill string 11 and the upper end portion of cylindrical housing 30. Top sub 20 may include a central through passage 25 in fluid communication with drill string 11. As shown in FIG. 3, passage 25 may include a generally uniform diameter upper section 25*a*, a lower enlarged diameter section 25*c*, and a generally frustoconical transition section 25*b* extending therebetween. The upper end portion of fluid conduit 50 may be disposed in lower enlarged diameter section 25*c*, and coupled to top sub 20 with a pin 22 extending through top sub 20 and fluid conduit 50. The outer diameter of the fluid conduit 50 may be less than the diameter of lower enlarged diameter section 25*c*, and thus, an annular region 25*d* may be formed between fluid conduit 50 and top sub 20.

Referring again to FIGS. 1 and 2, the lower end portion of cylindrical housing 30 may be threadingly or otherwise coupled to the upper end portion of driver sub 40. Annular piston 35 may be slidingly disposed in cylindrical housing 30 above hammer bit 60 and may cyclically impact hammer bit 60 at the interface of piston strike face 91 and bit strike face 93. The central through passage 33 in annular piston 35 may slidingly receive the lower end portion of feed tube 50. Annular piston 35 may also include a first set of one or more flow passages 36 extending from central passage 33 to a lower chamber 38, and/or a second set of one or more flow passages 37 extending from an upper chamber 39 to central passage 33. Lower chamber 38 may be defined by cylindrical housing 30, the lower end portion of annular piston 35, and guide sleeve 32, while upper chamber 39 may be defined by cylindrical housing 30, the upper end portion of annular piston 35, and the lower end portion of top sub 20.

During drilling operations, annular piston 35 may be reciprocally actuated within cylindrical housing 30 by alternating the flow of the fluid (e.g., compressed air, compressed nitrogen, etc.) between passage 36, 37 and chambers 38, 39, respectively. More specifically, annular piston 35 may have a first axial position in which outlet port 51 is axially aligned with passage 36, thereby placing first outlet port 51 in fluid communication with passage 36 and chamber 38. The annular piston 35 may also have a second axial position in which second outlet port 52 is axially aligned with passage 37, thereby placing second outlet port 52 in fluid communication with passage 37 and chamber 39. The intersection of passages 33, 36 may be axially spaced from the intersection of passages 33, 37. Thus, when first outlet port 51 is aligned with passage 36, second outlet port 52 may be misaligned with passage 37, and vice versa. It should be appreciated that annular piston 35 may assume a plurality of axial positions between the first position and the second position, each allowing varying degrees of fluid communication between ports 51, 52 and passage 36, 37, respectively.

In addition, hammer bit 60 may include a central longitudinal passage 65 in fluid communication with downwardly extending passages 62 having ports or nozzles 64 formed in the face of hammer bit 60. Bit passage 65 may also be in fluid communication with piston passage 33. As annular piston 35 moves axially upward relative to hammer bit 60, guide sleeve 32 may maintain the fluid communication between bores 33, 65. Compressed or other fluid exhausted from chambers 38, 39 into piston passage 33 of piston 45 may flow through bit passages 65, 62 and out ports or nozzles 64. Together, passages 62 and nozzles 64 may serve to distribute fluid around the face of bit 60 to flush away formation cuttings during drilling and to remove heat from bit 60.

During drilling operations, a fluid may be delivered down the drill string 11 from the surface in the direction of arrow 70. In some cases, the fluid may be provided by one or more compressors at or above the surface of a borehole. The compressed fluid may flow down drill string 11 into upper section 25*a* (FIG. 3) of passage 25. As shown in FIG. 3, with a sufficient pressure differential across check valve 57, closure member 58 may remain in an opened position allowing the compressed fluid to flow through annular region 25*d*, inlet ports 56, and down feed tube 50 to outlet ports 51, 52 and choke 55. The flow of compressed fluid may be divided between ports 51, 52 and choke 55. In particular, a first fraction of the compressed fluid may flow radially outward through ports 51 and/or ports 52, as represented by arrow 70*a*. A second fraction of the compressed fluid may flow through choke 55 into a central piston passage 33, as represented by arrow 70*b*. In general, the first fraction of the compressed fluid flowing through outlet ports 51, 52 may serve to cyclically actuate annular piston 35, while the second fraction of the compressed fluid flowing through choke 55 may flow through passages 33, 65, 62 and exit hammer bit 60 via ports 64, thereby flushing cutting from the face of bit 60. Since the flow of compressed fluid through outlet ports 51, 52 may actuate annular piston 35, outlet ports 51, 52 may also be referred to as "piston actuation" ports.

Returning now to FIGS. 1 and 2, at the same time, drill string 11 and drilling assembly 10 may be rotated. Mating splines 61, 41 on bit 60 and driver sub 40, respectively, may allow bit 60 to move axially relative to driver sub 40 while simultaneously allowing driver sub 40 to rotate bit 60 with drill string 11. The rotation of hammer bit 60 allows the cutting elements (not shown) of bit 60 to be "indexed" to fresh rock formations during each impact of bit 60. Compressed or other fluid exiting hammer bit 60 through ports 64 may flow upward from the base of the borehole through the annulus between drilling assembly 10 and the borehole sidewall to the surface.

Although one example of a hammer bit having a bit strike face and annular piston having a piston strike face has been discussed, one having ordinary skill in the art will understand in view of the disclosure herein that any hammer bit and annular piston in a percussion drilling assembly may be used without departing from the scope of the disclosure herein.

One or more embodiments disclosed herein are directed to an optimized strike interface between annular piston and drill bit shank for a percussion hammer. The optimized strike interface may enhance the life span of the components. According to one or more embodiments of the present disclosure, in reference to FIG. 4, annular piston 435 and/or annular bit shank 460 may have a toroidal curvature profile 490, 492 at the strike interface between them. When a component, such as annular piston 435 or annular bit shank 460, undergoes an impact, the stress imparted to the component may be greater than the yield strength of the material (e.g., metal) making up the component. When this occurs, the component may be plastically deformed. In the case of metal, plastic deformation may, in addition to causing a permanent shape change, cause the metal to generally become harder but more brittle than it was before deformation. Additionally, internal stresses may be introduced within the material. This phenomenon is known as work hardening. As a result of the increased hardness and internal stresses, the component may be more prone to material failure by chipping or cracking. By optimizing the toroidal curvature profiles 490, 492, the stresses imparted to both the annular piston 435 and the annular bit shank 460 may remain below the yield strengths of the components. The annular piston 435 and annular bit shank 460 may have increased resistance to plastic deformation and may therefore not plastically deform to remain within an elastic strain regime during drilling operations.

Additionally, because liquids are often present in the borehole, the annular piston 435 and the annular bit shank 460 may trap a portion of fluid between them upon impact. The presence of a non-compressible liquid at the interface between piston strike face 491 and bit strike face 493 (known as wash off) may increase localized stresses on a component. The toroidal curvature profile in one or more embodiments of the present disclosure may help reduce or prevent wash off by reducing the number of flat surfaces within the assembly. Also, a convex bit strike face 493 may provide for additional run-off of liquids moving by gravity alone.

Figure 9:
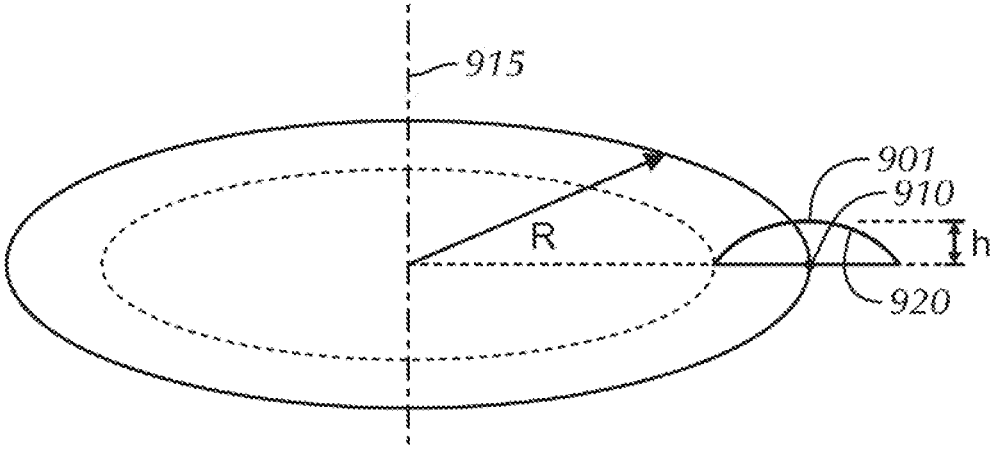
FIG. 9 is a reference figure to help explain terms used with the disclosure herein.

For the sake of clarifying terminology used throughout the disclosure, reference is now made to FIG. 9. A toroid is a three-dimensional surface formed when a two-dimensional radial cross-section 901 is rotated about an axis 915. For a circular toroid, a major radius R, measured between the axis 915 and the center-point 910 of cross-section 901, is constant. As used herein, toroidal curvature profile means a three-dimensional surface swept out by a curve profile 920 when rotated about axis 915 at a constant major radius R. As defined herein, a toroidal curvature profile may refer either to a convex extension of a body—as in the bit strike face 493 depicted in FIG. 4—or a concave recess into a body—as in the piston strike face 491 depicted in FIG. 4. Furthermore, a curve profile height h as used throughout this disclosure is defined as a distance from center-point 910 to the highest point of the curve profile 920 when the curve 920 extends in a positive longitudinal direction. Curve profile height h is measured from the center-point 910 to the lowest point of the curve 920 when the curve profile 920 extends in a negative longitudinal direction.

Where curve profile 920 is an arc section from a circle, curve 920 may be defined in terms of a radius of curvature r, defined as the distance to the center of the circle of which the arc forms a partial circumference. One having ordinary skill in the art will understand that any curve 920 may be used to form a toroidal curvature profile, including, for instance, circular, elliptical, hyperbolic, and parabolic curves while remaining within the scope of this disclosure. Additionally, one having ordinary skill in the art will understand that curve 920 may be constructed from segments of more than one type of curve while remaining within the scope of this disclosure. For example, FIGS. 10A-E depict several illustrative curve profiles which may define toroidal curvature profiles within the scope of one or more embodiments of this disclosure.

Figure 10A:
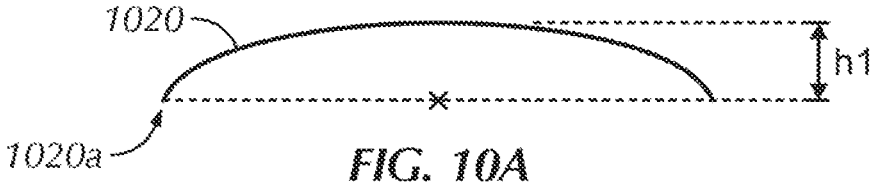
FIGS. 10A-E are examples of curve profiles which may define toroidal curvature profiles within the scope of one or more embodiments of this disclosure.
Figure 10B:
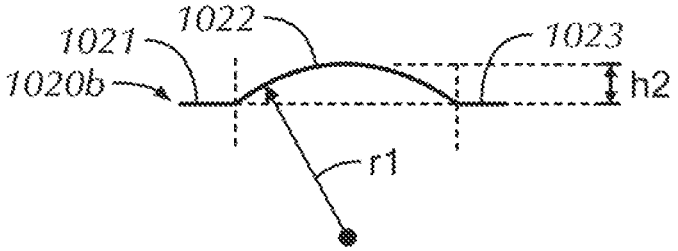
Figure 10C:
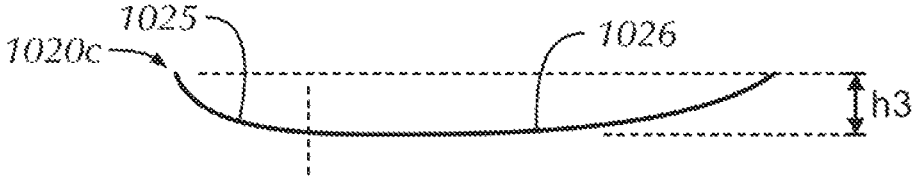
Figure 10D:
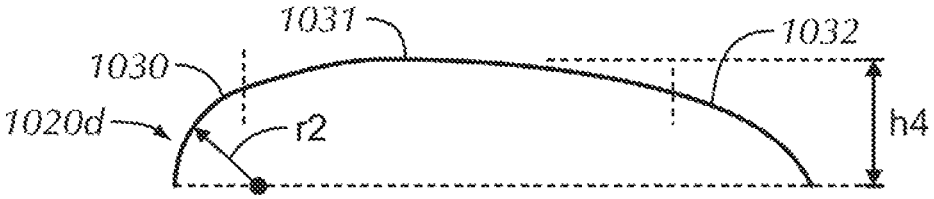
Figure 10E:
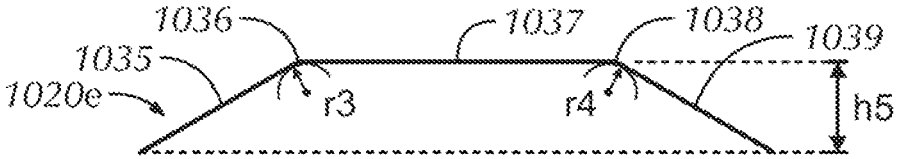

Curve profile 1020*a* of FIG. 10A is illustrated as an elliptical curve 1020 having height h1. Curve profile 1020*b* of FIG. 10B is a compound curve profile having curve profile height h2 made up of a first line segment 1021, a circular arc 1022 having radius of curvature r1, and a second line segment 1023. Curve profile 1020*c* of FIG. 10C is a compound curve profile having curve profile height h3—which is negative—made up of a first elliptical arc 1025, and a second elliptical arc 1026. Curve profile 1020*d* of FIG. 10D is a compound curve profile having curve profile height h4 made up of a circular arc 1030 having a radius of curvature r2, a curvilinear portion 1031 and an elliptical arc 1032. Curve profile 1020*e* of FIG. 10E is a compound curve profile having curve profile height h5 made up of a first line segment 1035, a first circular arc 1036 having a radius of curvature r3, a second line segment 1037, a second circular arc 1038 having a radius of curvature r4, and a third line segment 1039.

Figure 4:
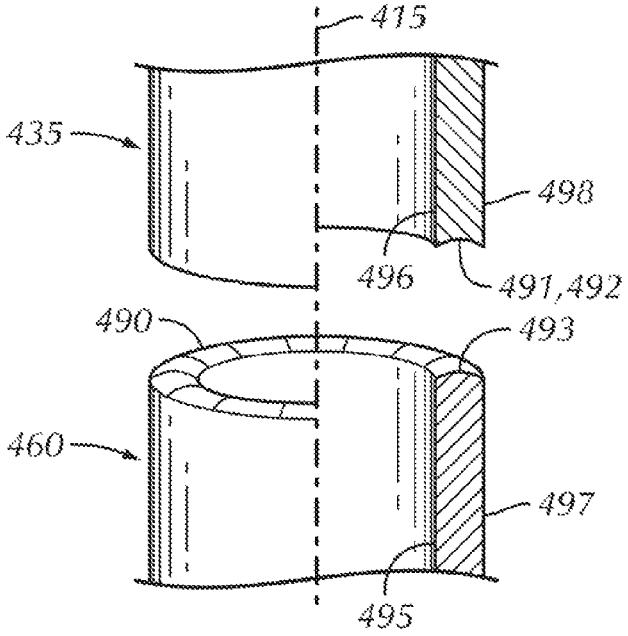
FIG. 4 is an enlarged partial cross-sectional view of a lower end portion of an annular piston and an upper end portion of an annular drill shank in accordance with one or more embodiments disclosed herein.

In one or more embodiments of the present disclosure, at least one of the piston strike face or the bit strike face has a convex toroidal curvature profile. In one embodiment, as depicted in FIG. 4, the bit strike face 493 of annular bit shank 460 may have a convex toroidal curvature profile 490. The axis of the toroidal curvature profile 490 may substantially correspond with axis 415. The radial cross-section of the toroidal curvature profile may have a curve extending from an inner surface 495 to an outer surface 497 on the annular bit shank 460.

Still referring to FIG. 4, the piston strike face 491 of annular piston 435 may have a concave toroidal curvature profile 492 in some embodiments. The axis of the concave toroidal curvature profile 492 may also substantially correspond with axis 415. The radial cross-section of the concave toroidal curvature profile 492 may have a curve extending from an inner surface 496 to an outer surface 498 on the annular piston 435.

Annular piston 435, annular bit shank 460, other components of a percussion drilling assembly, such as the cylindrical housing, or some combination of the foregoing, may be formed by any conventional process known in the art, and the toroidal cutting profile may be formed integrally or separately from the annular piston or hammer bit. For example, one or more embodiments of the present disclosure may include forming an annular piston or hammer bit by casting, molding, forging, rolling, grinding, milling, turning, cutting, routing, etc.

Figure 5:
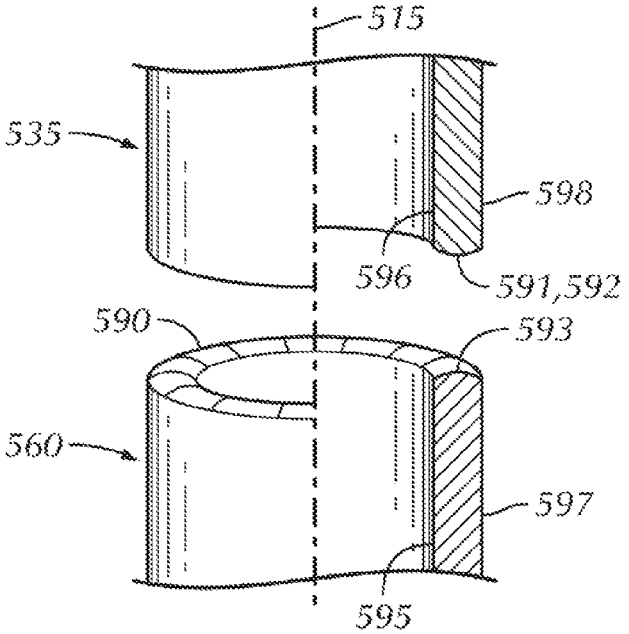
FIG. 5 is an enlarged partial cross-sectional view of a lower end portion of an annular piston and an upper end portion of an annular drill shank in accordance with one or more embodiments disclosed herein.

As shown in the embodiment depicted in FIG. 5, the bit strike face 590 of annular bit shank 560 may have a convex toroidal curvature profile 590. The axis of the toroidal curvature profile 590 may substantially correspond with axis 515. The radial cross-section of the toroidal curvature profile may have a curve extending substantially from an inner surface 595 to an outer surface 597 on the annular bit shank 560.

In FIG. 5, the piston strike face 591 of annular piston 535 may also have a convex toroidal curvature profile 592. The axis of the convex toroidal curvature profile 592 may also substantially correspond with axis 515. The radial cross-section of the convex toroidal curvature profile 592 may have a curve extending substantially from an inner surface 596 to an outer surface 598 on the annular piston 535.

Figure 6:
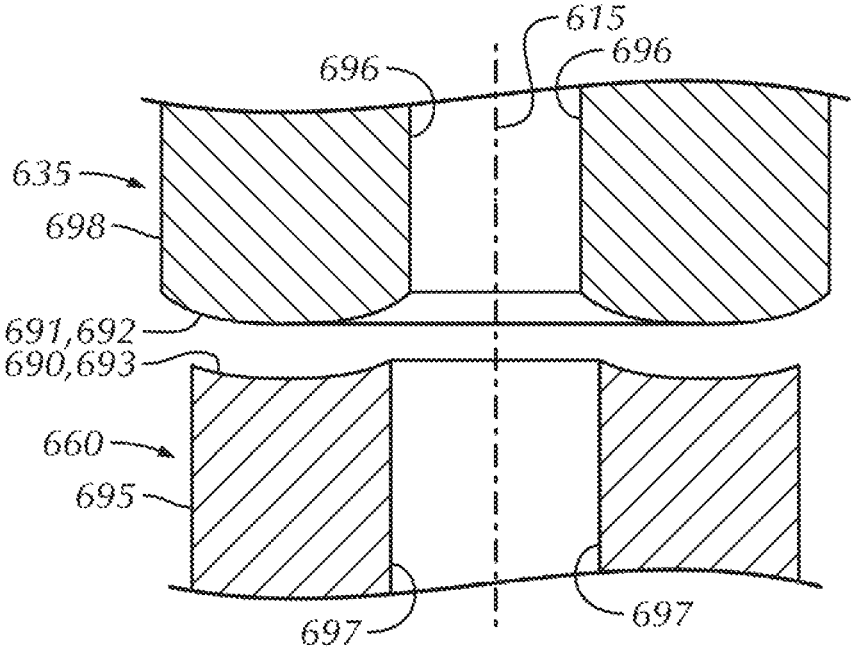
FIG. 6 is an enlarged cross-sectional view of a lower end portion of an annular piston and an upper end portion of a drill shank in accordance with one or more embodiments disclosed herein.
Figure 7:
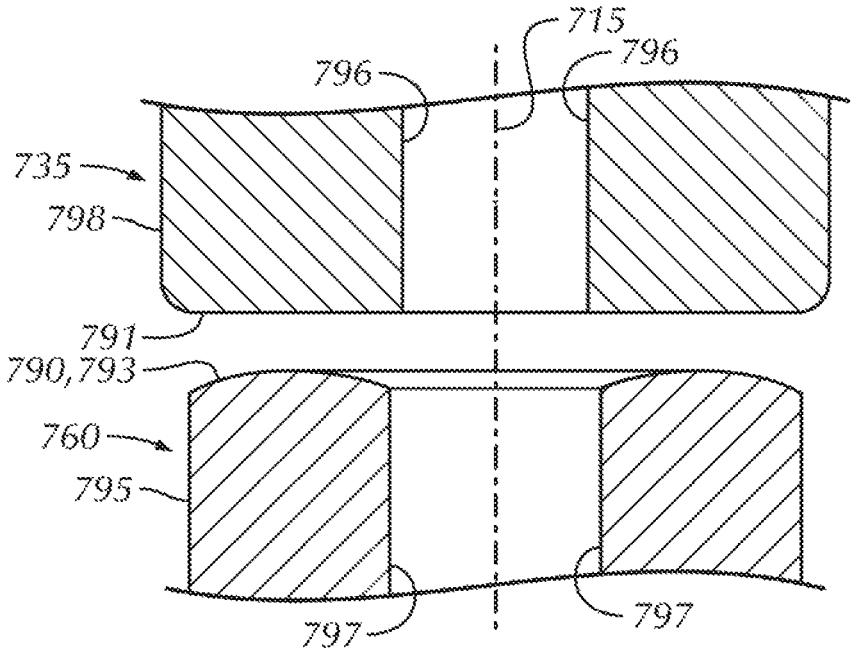
FIG. 7 is an enlarged cross-sectional view of a lower end portion of an annular piston and an upper end portion of a drill shank in accordance with one or more embodiments disclosed herein.
Figure 8:
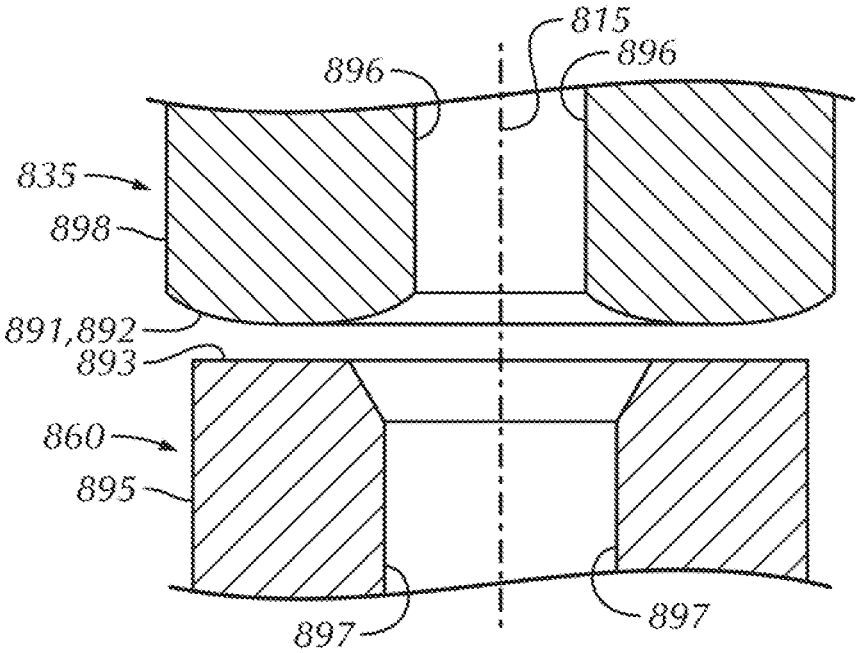
FIG. 8 is an enlarged cross-sectional view of a lower end portion of an annular piston and an upper end portion of a drill shank in accordance with one or more embodiments disclosed herein.

FIGS. 6-8 are partial cross-sectional views of further embodiments of the present disclosure, and show illustrative interfaces between a lower end portion of an annular piston and an upper end portion of an annular bit shank.

In an embodiment according to the disclosure, as depicted in FIG. 6, the piston strike face 691 of annular piston 635 may have a convex toroidal curvature profile 692. The axis of the toroidal curvature profile 692 may substantially correspond with axis 615. The radial cross-section of the toroidal curvature profile may have a curve extending substantially from an inner surface 696 to an outer surface 698 on the annular piston 635.

The bit strike face 693 of annular bit shank 660 may have a concave toroidal curvature profile 690. The axis of the concave toroidal curvature profile 690 may also substantially correspond with axis 615. The radial cross-section of the concave toroidal curvature profile 690 may have a curve extending substantially from an inner surface 695 to an outer surface 697 on the annular bit shank 660. A thickness of the walls of the annular piston 635 may be about the same as, less than, or greater than (as shown) the thickness of the walls of the annular bit shank.

As shown in the embodiment depicted in FIG. 7, the bit strike face 793 of annular bit shank 760 may have a convex toroidal curvature profile 790. The axis of the toroidal curvature profile 790 may also substantially correspond with axis 715. The radial cross-section of the toroidal curvature profile may have a curve extending substantially from an inner surface 797 to an outer surface 795 on the annular bit shank 760. As also illustrated, the piston strike face 791 of annular piston 735 may have a flat profile, meaning the piston strike face 791 may be generally planar and orthogonal to axis 715.

As shown in the embodiment depicted in FIG. 8, the piston strike face 891 of annular piston 835 may have a convex toroidal curvature profile 892. The axis of the convex toroidal curvature profile 892 may also substantially correspond with axis 815. The radial cross-section of the convex toroidal curvature profile 892 may have a curve extending substantially from an inner surface 896 to an outer surface 898 on the annular piston 835. As shown, the bit strike face 893 of the annular bit shank 860 may have a flat profile. As used herein, a flat profile refers to a profile of a surface (e.g., of the bit strike face 893), that is generally planar and orthogonal to axis 815.

In FIGS. 4-8, the cross-section of the curved profile is depicted as a circular arc, but as previously discussed, one having ordinary skill in the art will also understand in view of the disclosure herein that an elliptical, hyperbolic, parabolic, other curve profile, or some combination of the foregoing may be used and may be suitable for reducing stress concentrations and may still conform with the present disclosure.

Additionally, FIGS. 4-8 illustrate the piston strike faces and the bit strike faces as having equal radii of curvature. As discussed herein, one having ordinary skill in the art will understand in view of the disclosure herein that the radius of curvature—and indeed the profile shapes—of a piston strike face and a bit strike face may not be the same, match, or mate. For instance, a radius of curvature of a concave strike face may be larger than a radius of curvature of a corresponding bit strike face. Alternatively, when two convex strike faces are used, they may be of different radius of curvature. Moreover, some strike faces may not have a radius of curvature, such as where the strike face has a flat profile. According to one or more embodiments of the present disclosure, a toroidal curvature profile disposed on a strike face may have a radius of curvature of between 0.5 inch and 150 inches (13 mm to 3.81 m). In one or more other embodiments, a toroidal curvature profile disposed on a strike face may have a radius of curvature between 1 inch and 4 inches (25 mm to 102 mm).

According to one or more other embodiments of the present disclosure, a toroidal curvature profile disposed on a strike face may have a curve profile height h of between 0.0005 inch and 0.040 inch (13 μm to 1 mm). In one or more other embodiments, the curve profile height h may be between 0.0005 inch and 0.4 inches (13 μm to 10 mm).

A method of making a percussion drilling assembly is now described. Such method may include positioning or otherwise disposing a longitudinally movable annular piston at least partially in a housing, with the longitudinally movable annular piston including a piston strike face at a lower end portion. The housing may include a lower end portion and an upper end portion, the upper end portion capable of being coupled to a drill string. A hammer bit may be positioned or otherwise disposed at least partially within the housing, and potentially axially lower than the longitudinally movable annular piston so that a bit strike face is opposite the piston strike face. The bit strike face may be at an upper end of the hammer bit. One or both of the bit strike face or the piston strike face may also have a toroidal curvature profile thereon.

In one or more embodiments, a method may also include forming the housing with upper and lower end portions, the upper end portion being capable of being coupled to a drill string. A method may include forming a longitudinally movable annular piston with a strike face at a lower end portion thereof. A method may include forming a hammer bit with a bit strike face at an upper end portion and a cutting structure at a lower end portion. A method may include forming a toroidal curvature profile on one or more of a bit strike face or a piston strike face.

In one or more embodiments, a method may also include selecting a toroidal curvature profile to distribute impact stress and reduce, if not prevent, plastic deformation in the annular piston and/or the annular bit shank. A method may also include selecting the toroidal curvature profile to reduce or minimize wash off.

A method of drilling with a percussion drilling assembly is also described. Such method may include lowering or otherwise placing a percussion drilling assembly in a borehole. The percussion drilling assembly may include a percussion drilling assembly such as those described herein. An example percussion drilling assembly may include a housing having a lower end portion and an upper end portion, the upper end portion capable of being coupled to a drill string. The percussion drilling assembly may include a hammer bit in the lower end portion of the housing, which hammer bit may be configured to move longitudinally within the housing. The hammer bit may include an annular bit shank with a bit strike face at its upper end portion and a cutting structure at its lower end portion. The percussion drilling assembly may further include an annular piston disposed in the housing, the annular piston having a piston strike face at its lower end portion. At least one of the bit strike face or the piston strike face may have a toroidal curvature profile. The method may also include engaging or contacting the cutting structure of the percussion drilling assembly with a formation and causing the bit strike face of the annular bit shank to impact or strike the piston strike face of the annular piston.

Although only a few example embodiments have been described in detail above, those skilled in the art will readily appreciate that many modifications are possible in the example embodiments without materially departing from embodiments disclosed herein. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A percussion drilling assembly, comprising:

a housing capable of being coupled to a drill string;

a hammer bit coupled to a lower end portion of the housing and configured to move longitudinally relative to the housing, the hammer bit including an annular bit shank having a bit strike face at an upper end portion thereof and a cutting structure at a lower end portion thereof; and an annular piston coupled to the housing, the annular piston having a piston strike face at a lower end portion thereof arranged and designed to strike the bit strike face, at least one of the bit strike face or the piston strike face having a convex toroidal curvature profile with a convex portion configured to strike a flat or convex portion of a flat or convex toroidal curvature profile of the other of the bit strike face or the piston strike face.

2. The percussion drilling assembly of claim 1, a radial cross-section of the toroidal curvature profile forming a circular arc.

3. The percussion drilling assembly of claim 2, the circular arc defining a radius of curvature between 0.5 inch and 150 inches.

4. The percussion drilling assembly of claim 1, a radial cross-section of the toroidal curvature profile forming an elliptical arc.

5. The percussion drilling assembly of claim 4, a longitudinal width of the elliptical arc defining a height of the toroidal curvature profile, the height of the toroidal curvature profile being between 0.0005 inch and 0.4 inch.

6. The percussion drilling assembly of claim 1, a radial cross-section of the toroidal curvature profile forming a curve having at least two arc segments.

7. A method of making a percussion drilling assembly, comprising:

disposing a longitudinally movable annular piston at least partially in a housing having a lower end portion and an upper end portion, the upper end portion of the housing configured to couple to a drill string, the longitudinally movable annular piston having a piston strike face around a piston central passage at a lower end portion thereof, the longitudinally movable annular piston further having an inner piston surface defining the piston central passage and having an outer piston surface; and disposing a hammer bit at least partially in the housing lower than the longitudinally movable annular piston, the hammer bit having an annular bit shank with a bit strike face around a bit central passage at an upper end portion thereof, and a cutting structure at a lower end thereof, the hammer bit including an inner bit surface defining the bit central passage and includes an outer bit surface, the bit strike face being positioned opposite the piston strike face, and at least one of the following:

a toroidal curvature profile on the piston strike face, the toroidal curvature profile of the piston strike face having a greater height at a center-point between the inner and outer piston surfaces than at the inner and outer piston surfaces; or a toroidal curvature profile on the bit strike face, the toroidal curvature profile of the bit strike face having a greater height at a center-point between the inner and outer bit surfaces than at the inner and outer bit surfaces.

8. The method of claim 7, the bit strike face having a convex toroidal curvature profile.

9. The method of claim 7, the piston strike face having a convex toroidal curvature profile.

10. The method of claim 7, a radial cross-section of the toroidal curvature profile forming a circular arc.

11. The method of claim 7, a radial cross-section of the toroidal curvature profile forming an elliptical arc.

12. The method of claim 7, further comprising:

selecting the toroidal curvature profile to redistribute impact stress and prevent plastic deformation in one or more of the annular piston or the annular bit shank.

13. The method of claim 12, further comprising:

selecting the toroidal curvature profile to minimize wash off.

14. A method of drilling with a percussion drilling assembly, comprising:

extending a percussion drilling assembly into a borehole, the percussion drilling assembly including:

a housing with a lower end portion and an upper end portion, the upper end portion capable of being coupled to a drill string;

a hammer bit at least partially within the lower end portion of the housing and configured to move longitudinally relative to the housing, the hammer bit having an annular bit shank with a bit strike face at an upper end portion of the annular bit shank, the bit strike face extending around a bit central passage, and the hammer bit including a cutting structure at a lower end portion of the annular bit shank; and an annular piston at least partially within the housing, the annular piston having a piston strike face at a lower end portion thereof, the piston strike face extending around a piston central passage, the piston strike face being arranged and designed to strike the bit strike face, wherein at least one of the piston strike face or bit strike face has a toroidal curvature profile in which:

for the piston strike face, the toroidal curvature profile has a greater height at a radial position between the inner and outer piston surfaces than at the inner and outer piston surfaces; and for the bit strike face, the toroidal curvature profile has a greater height at a center-point of a wall around the bit central passage than at inner and outer bit surfaces;

engaging the cutting structure with a formation; and causing the bit strike face to impact the piston strike face.

15. The method of claim 14, the piston strike face having a convex toroidal curvature profile.

16. The method of claim 15, the bit strike face having a convex or flat toroidal curvature profile.

17. The method of claim 14, the bit strike face having a convex toroidal curvature profile.

18. The method of claim 17, the piston strike face having a convex or flat toroidal curvature profile.

* * * * *